US007681634B2

(12) United States Patent
Botnmark et al.

(10) Patent No.: US 7,681,634 B2
(45) Date of Patent: Mar. 23, 2010

(54) APPARATUS FOR WIPING THE INTERIOR OF PIPES

(75) Inventors: Ketil Botnmark, Narvik (NO); Kjell Mikalsen, Narvik (NO)

(73) Assignee: 2K Tech AS, Narvik (NO)

( * ) Notice: Subject to any disclaimer, the term of this patent is extended or adjusted under 35 U.S.C. 154(b) by 112 days.

(21) Appl. No.: 11/632,578

(22) PCT Filed: Jul. 15, 2005

(86) PCT No.: PCT/NO2005/000263

§ 371 (c)(1),
(2), (4) Date: Jul. 30, 2007

(87) PCT Pub. No.: WO2006/006872

PCT Pub. Date: Jan. 19, 2006

(65) Prior Publication Data

US 2007/0277970 A1 Dec. 6, 2007

(30) Foreign Application Priority Data

Jul. 15, 2004 (NO) ..... 20042986

(51) Int. Cl.
*E21B 33/08* (2006.01)

(52) U.S. Cl. ..... 166/177.3; 166/170; 166/172; 166/173

(58) Field of Classification Search ..... 166/172, 166/173, 177.3; 15/104.05, 104.16, 104.17, 15/104.18; 81/465, 485, 486
See application file for complete search history.

(56) References Cited

U.S. PATENT DOCUMENTS

| | | | | | |
|---|---|---|---|---|---|
| 475,506 | A | * | 5/1892 | Kingsland | 15/104.18 |
| 1,732,277 | A | * | 10/1929 | Owens | 15/104.16 |
| 2,149,824 | A | * | 3/1939 | Wettermark | 166/176 |
| 2,237,863 | A | * | 4/1941 | Donaldson | 166/173 |
| 2,257,080 | A | * | 9/1941 | Turner | 175/318 |
| 2,460,481 | A | * | 2/1949 | Abel | 166/177.3 |
| 2,740,480 | A | * | 4/1956 | Cox | 166/170 |
| 4,034,807 | A | | 7/1977 | Prince et al. | |
| 4,221,264 | A | | 9/1980 | Haggard | |
| 4,287,948 | A | | 9/1981 | Haggard | |
| 4,923,011 | A | * | 5/1990 | Skipper | 166/311 |
| 5,012,866 | A | * | 5/1991 | Skipper | 166/170 |
| 5,732,774 | A | * | 3/1998 | Haggard | 166/153 |
| 5,836,386 | A | * | 11/1998 | Haggard | 166/177.3 |
| 6,371,207 | B1 | * | 4/2002 | Reynolds | 166/312 |
| 2002/0144812 | A1 | | 10/2002 | Smith, Jr. | |
| 2004/0065446 | A1 | * | 4/2004 | Tran et al. | 166/384 |

* cited by examiner

*Primary Examiner*—Jennifer H Gay
*Assistant Examiner*—Blake Michener
(74) *Attorney, Agent, or Firm*—Knobbe Martens Olson & Bear LLP

(57) ABSTRACT

An apparatus is provided for cleaning a drill string of drilling mud during tripping, the apparatus being provided with a mass and a volume such that it is able to float on a surface of the drilling mud in the drill string during the tripping operation. The apparatus includes a wiper device which is bellows-shaped, and a weight which is fastened to the top of the wiper device.

5 Claims, 9 Drawing Sheets

APPARATUS FOR WIPING THE INTERIOR OF PIPES

The present invention relates to an apparatus which is provided for cleaning a drill string of drilling mud during tripping. The apparatus is provided with a mass and a volume such that it is able to float on a surface of the drilling mud in the drill string during the tripping operation. The apparatus comprises a wiper device.

When drilling for oil offshore and onshore, there will be a need to pull the drill string and bit up at regular intervals. The drill string consists of drill pipes that are screwed together, and when the drill string is pulled out, it is usual to withdraw lengths of three connected drill pipes at a time, which are then set aside on a pipe rack. These, as a rule three, pipes are called a stand. The pulling out (tripping) continues by pulling out stand after stand until the whole drill string has been pulled out.

In drilling operations, problems often arise because drilling fluid or mud, as a result of inadequate or no cleaning, remains inside the drill pipes after the drill string has been pulled up. The mud dries out and forms hard flakes and clumps. When the drill pipes go back into operation, the clumps and particles may be pumped down to the drill bit where they may block one or more of the nozzles, resulting in damage to the drill bit. It is likely that this may also cause problems for downhole tools and motors. Often large amounts of mud spillage end up on the drill floor and on decks of storage areas. This creates unnecessary work cleaning the decks and disposing of the spillage, and causes injuries as a result of slippery, muddied decks.

One of the objects of the present invention is to reduce the aforementioned problems in a simple manner. This is accomplished by removing the mud from the inside of the drill pipe before the stands are taken from the drill string and passed to the pipe rack. There is also an earning potential in reducing the amount of mud that would normally be wasted.

A further object of the invention is to reduce problems in connection with the changeover from one mud type to another (particularly from oil-base drilling mud to water-base drilling mud). Another object is to reduce the time spent flushing pipes. Furthermore, the invention also allows for the addition of an anti-corrosive agent inside the drill pipe.

U.S. Pat. No. 4,287,948 describes a wiper device for use in a drill string. The wiper device floats in the drilling fluid, and during tripping a circumferential edge of the device wipes the interior wall of the drill string clean of liquid.

According to the invention, an apparatus is provided for cleaning a drill string of drilling mud during tripping, the apparatus being provided with a mass and a volume such that it floats on a surface of the drilling mud in the drill string. The apparatus comprises a wiper device. The apparatus according to the invention is characterised in that the wiper device is bellows-shaped and that a weight is connected to the wiper device.

Advantageous embodiments of the device according to the invention are set forth in attached dependent claims 2-4.

One advantage of the apparatus according to the invention is that it has a simple design. Another advantage is that the apparatus projects only slightly above the fluid surface. This is advantageous since it reduces the danger of damage to the apparatus during the disconnection of drill pipes.

The invention will now be explained in more detail with reference to the attached figures which show examples of advantageous embodiments of the invention:

FIGS. 6*a*-6*d* show the pulling out of the apparatus using retrieval equipment.

Figure 7:
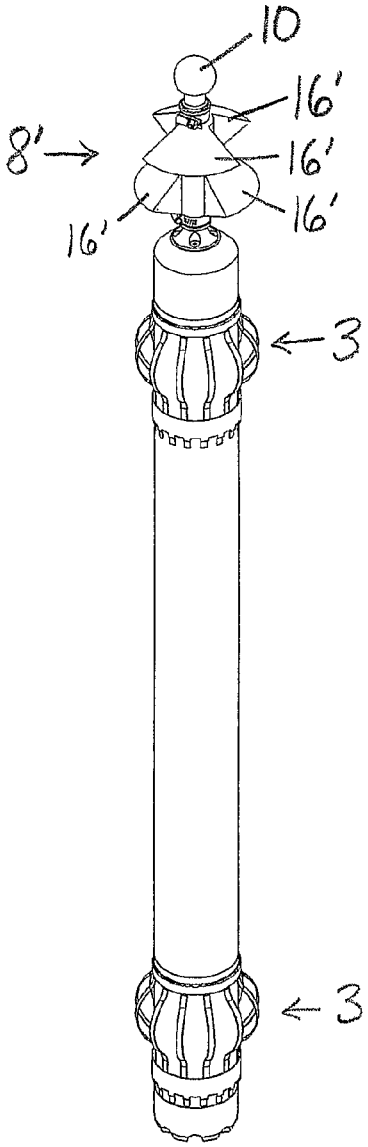

FIG. 7 is a perspective view of a second embodiment of the apparatus.

Figure 8:
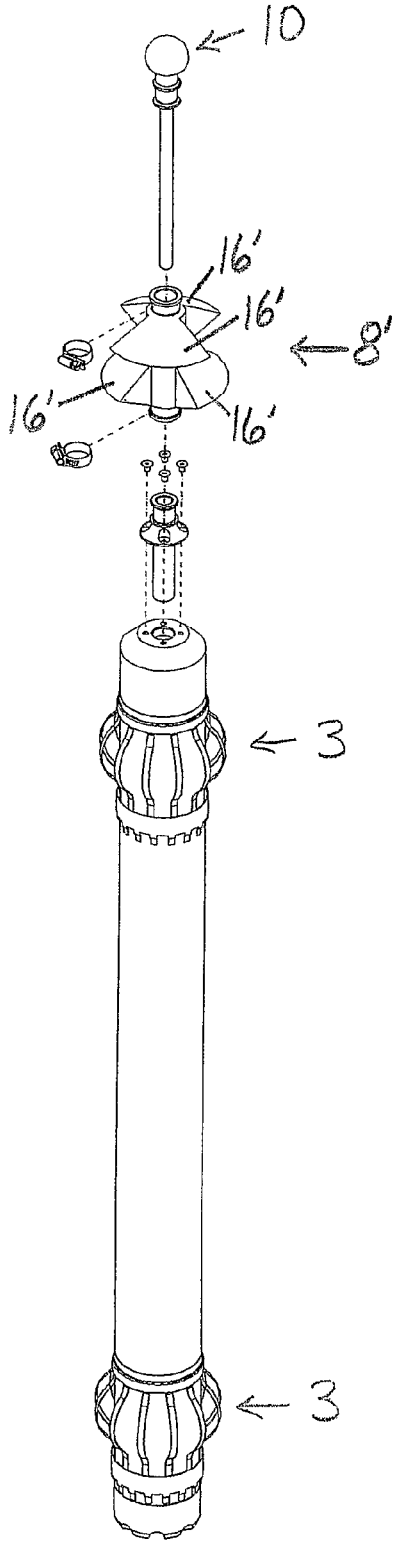

FIG. 8 is a split perspective view of the apparatus in FIG. 7.

Figure 9:
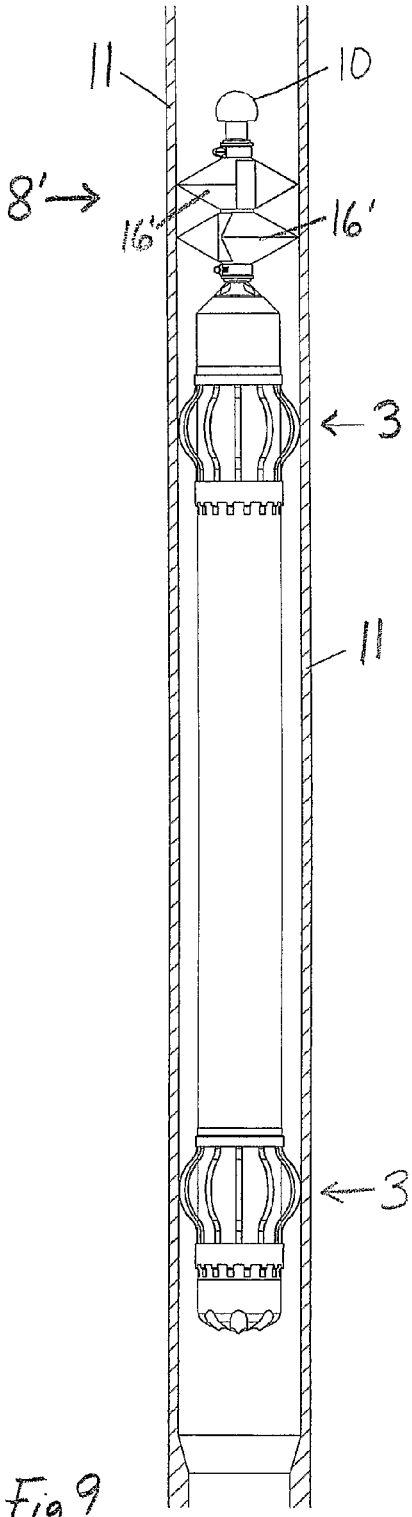

FIG. 9 is a side view of the same apparatus as in FIG. 7 placed in a drill string.

Figure 10:
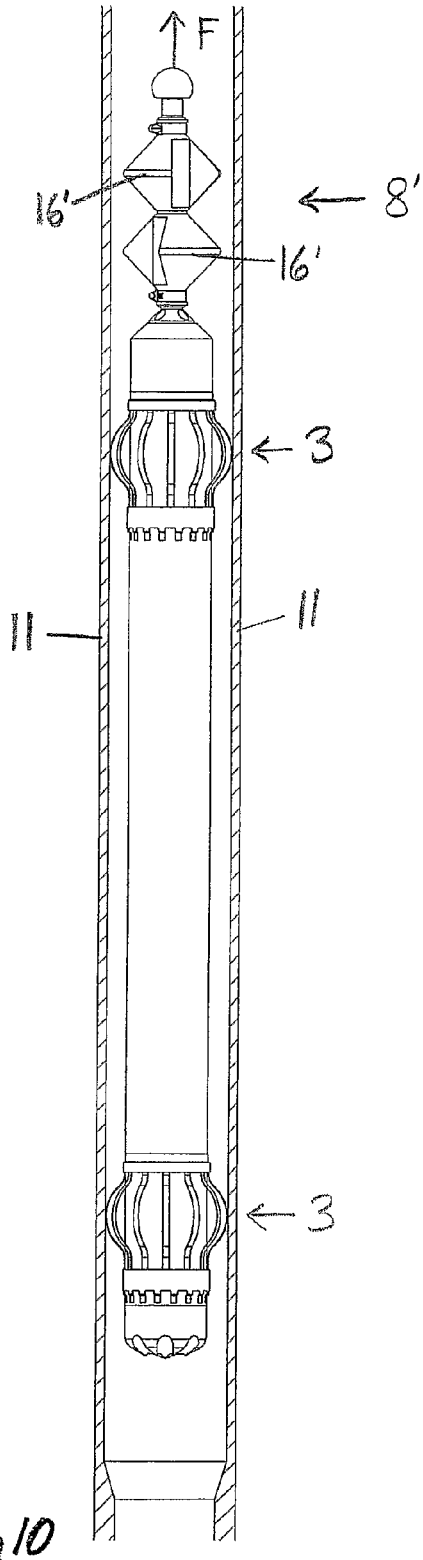

FIG. 10 is a side view of the same apparatus as in FIG. 7 as the apparatus is being pulled out of the drill string.

Figure 11:
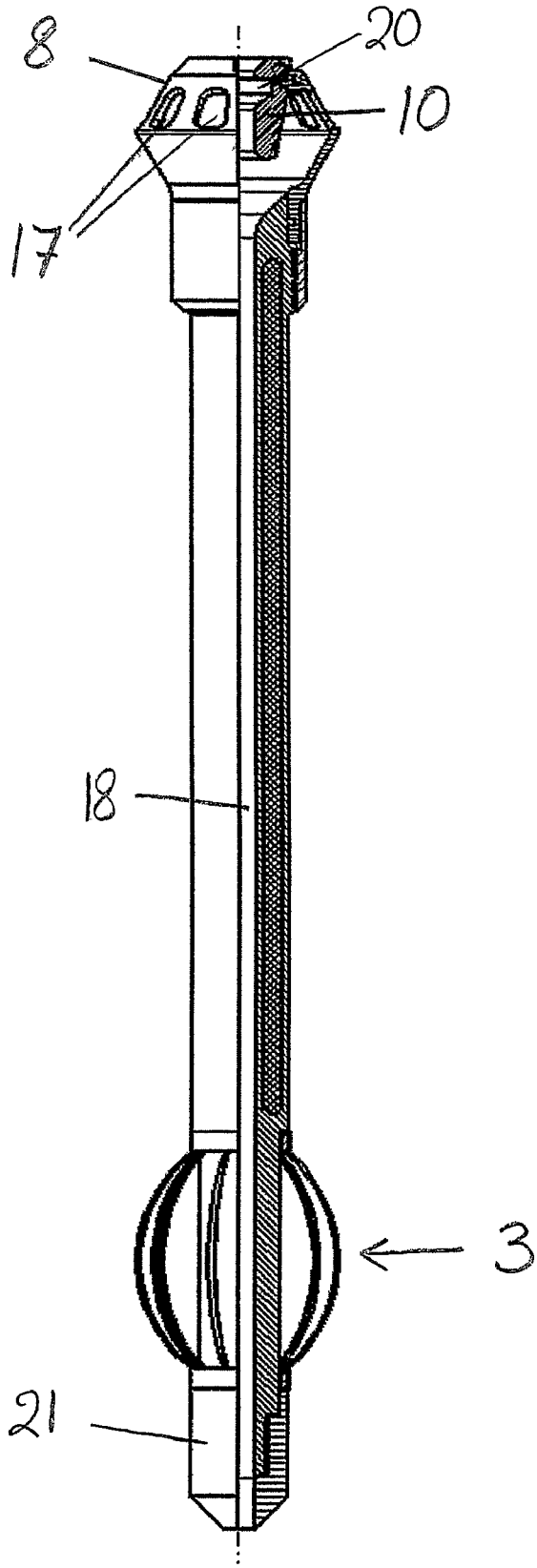

FIG. 11 is a view of another embodiment of the apparatus.

Figure 12:
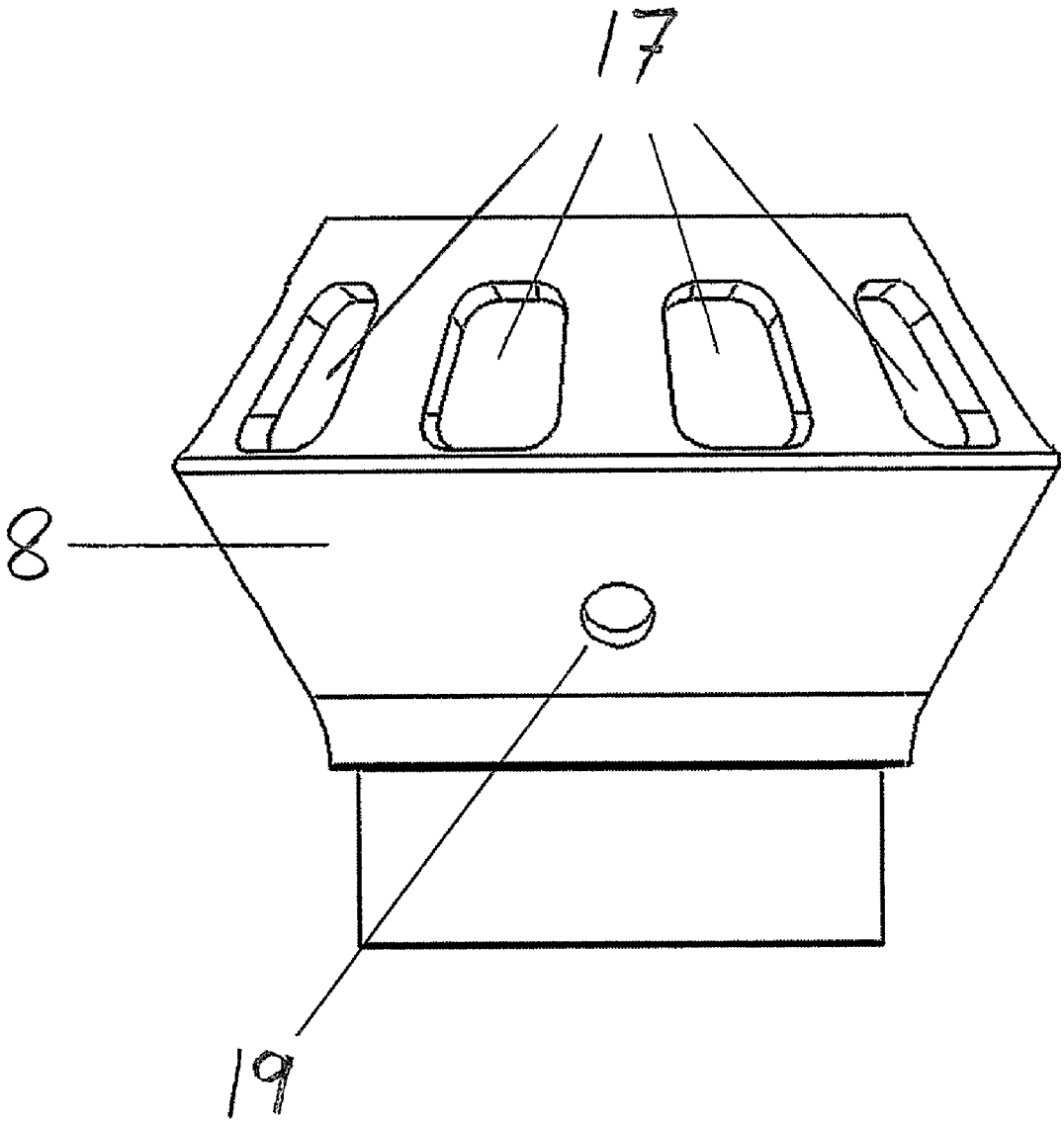

FIG. 12 is an enlarged view of the upper part of the apparatus shown in FIG. 11.

Figure 1:
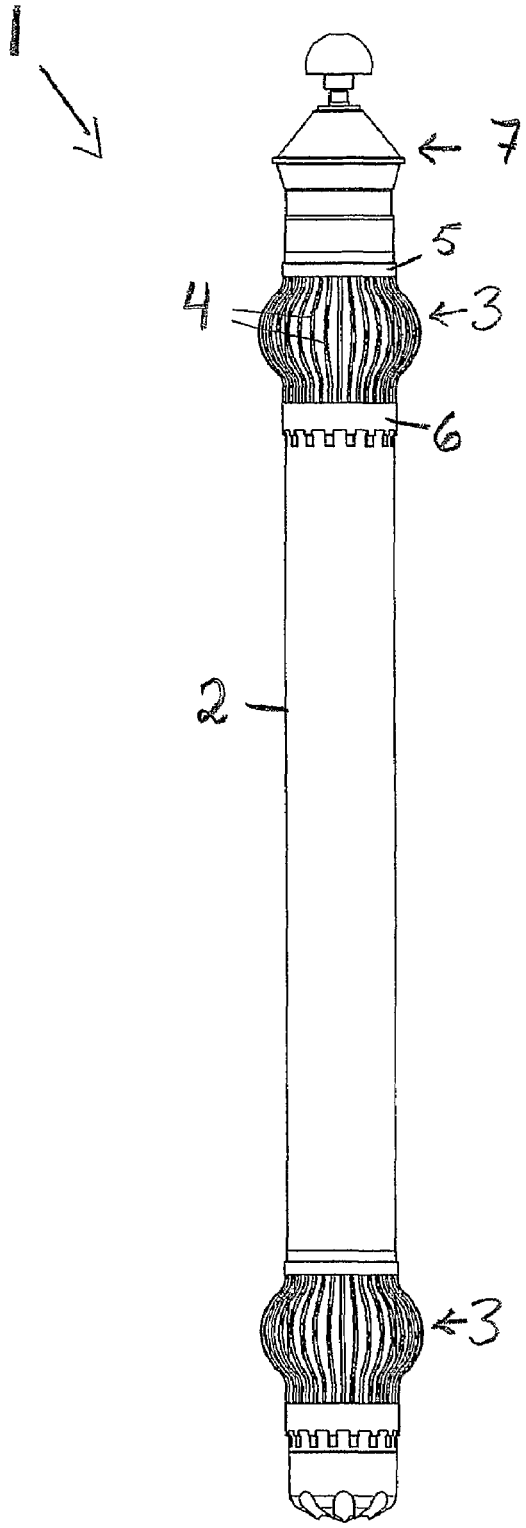
FIG. 1 is a longitudinal section of an embodiment of the apparatus according to the invention.

A typical embodiment of the apparatus 1 according to the invention is shown in FIG. 1. The apparatus 1 comprises a closed body 2 which can advantageously be tubular. The body 2 may, for example, have an external diameter of about ⅔ of the internal diameter of the drill string. The body 2 can be made of metal, a metal alloy or a composite material. In an advantageous embodiment, the body 2 can be made of aluminium.

The apparatus 1 comprises centralisers 3 which are mounted at the top and bottom of the closed body 2. The centralisers 3 may optionally only be mounted at the bottom. The centralisers 3 may comprise bands 4 that are secured to the closed body 2 by an annular fastener 5 at the top. At the bottom, the bands 4 may be slidably fastened by a second annular fastener 6. Thus, the centralisers 3 can alter their external diameter when the internal diameter of the drill string changes. The centralisers 3 may also have other shapes; for example, they may be in the form of blocks.

The bands 4 may, for example, be made of metal or of a plastics material.

Figure 2:
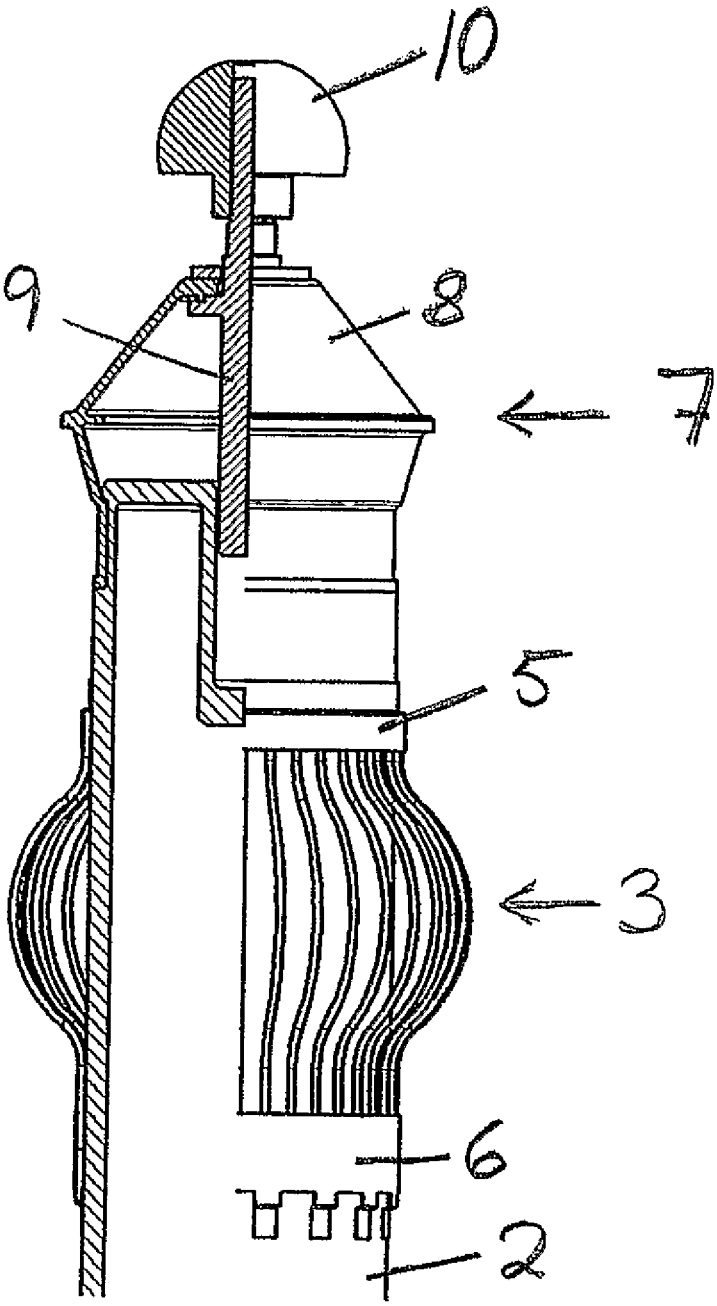
FIG. 2 is a partial longitudinal section of a top end part of the apparatus in FIG. 1, showing the end part in more detail.

The apparatus 1 further comprises a first end part 7 which is arranged at the top of the closed body 2. This is also shown in FIG. 2. The end part 7 comprises a wiper device 8. The bottom part of the wiper device 8 is mounted to and secured on the top end of the closed body 2. The wiper device 8 can typically be made of polyurethane or another flexible material which means that the shape of the wiper device 8 can be altered. Optionally, only parts of the bellows-shaped wiper device 8 may be made of a flexible material.

The upper part of the wiper device 8 is mounted to a shaft 9 that is able to slide axially in the top of the pipe. The upper part of the shaft can have a weight 10 mounted thereon which may be ball-shaped. The bellows shape means that when the gravitational force of the shaft and/or the weight 10 acts on the wiper device 8, the shape of the wiper device 8 will alter in that it is compressed in a vertical direction and at the same time expands sideways in a horizontal direction.

Figure 3:
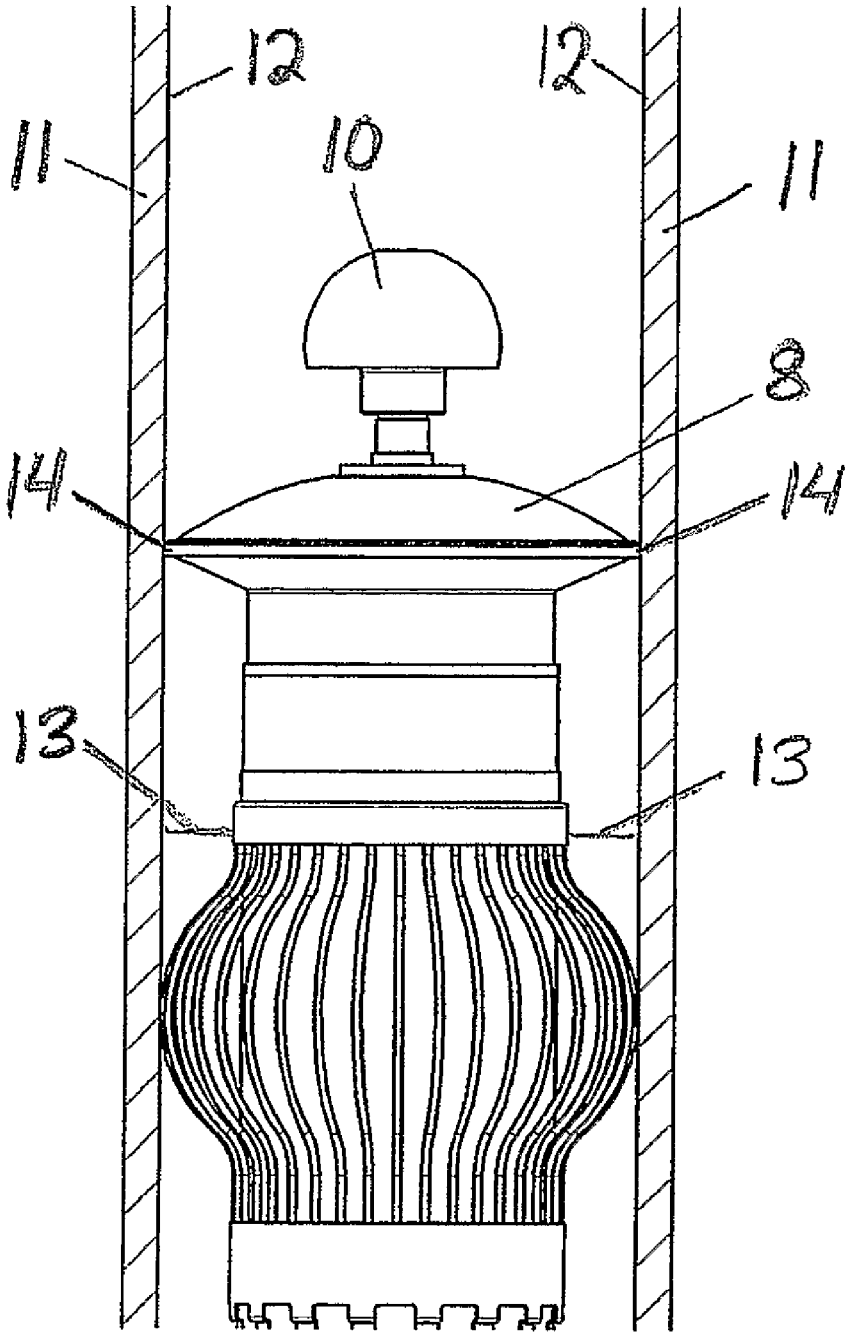
FIG. 3 is a longitudinal section of the top end part when the apparatus has been placed in a drill string.

During use, the apparatus 1 is placed inside a drill string 11 having an internal surface 12 when the pulling out (breaking) of the drill string is to be carried out. This is shown in FIG. 3. The drill string 11 contains mud/drilling fluid with a drilling fluid surface 13. The apparatus 1 is provided with a mass and a volume such that the device will remain floating on the drilling fluid surface 13. The weight of the apparatus 1 ensures that it falls down to the fluid surface 13 and places the circumferential edge 14 of the wiper device 8 about 10-15 cm above the fluid surface 13. The weight 10 in the top of the shaft 9 forces the edge 14 of the wiper device 8 against the interior surface 12 of the drill string. The weight 10 is sufficiently heavy to ensure that a certain wiping resistance can be exerted from the circumferential edge 14 against the interior surface 12 of the pipe wall, and at the same time is not so heavy that the apparatus 1 gets stuck in junctions, edges or other obstacles inside the drill string. As the drill string 11 is raised, the apparatus 1 will lie constantly on the fluid surface 13 and scrape off the drilling mud clinging to the interior surface 12 of the drill string 11.

One advantageous embodiment of the apparatus 1 may typically have a length of about 1 meter. A typical total weight of the apparatus 1 may be 5 kg.

Figure 4:
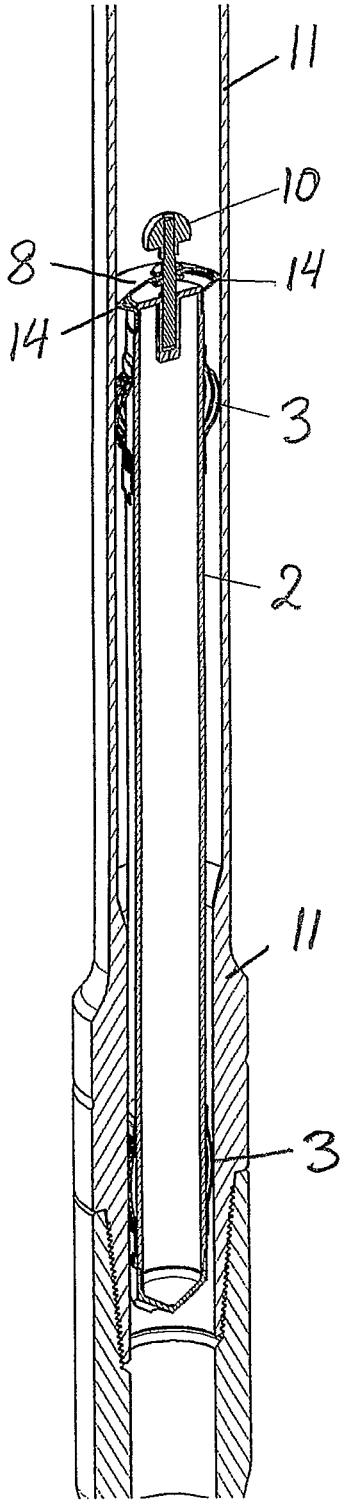
FIG. 4 is a longitudinal section of the apparatus in a drill string.

FIG. 4 is a longitudinal section of the apparatus 1 in a drill string 11.

Figure 5:
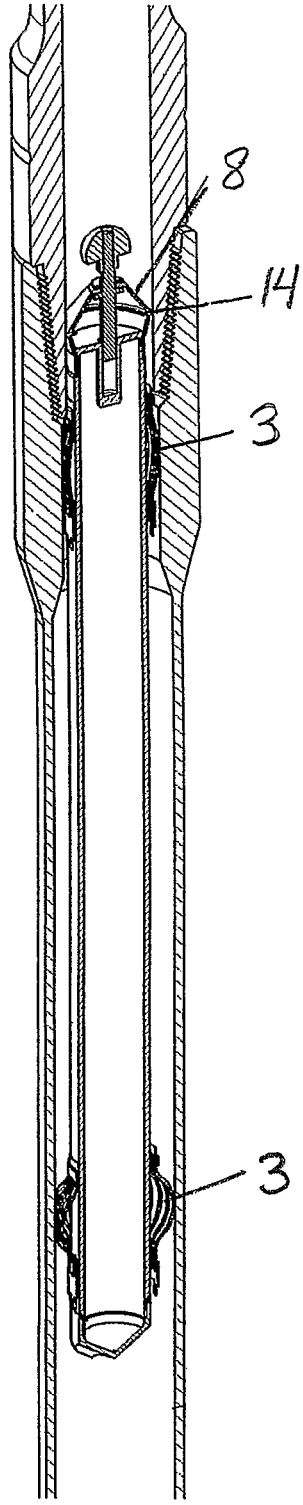
FIG. 5 is a longitudinal section of the device in FIG. 4 when the drill string has moved a little way upwards.
Figures 6A, 6B, 6C, 6D:
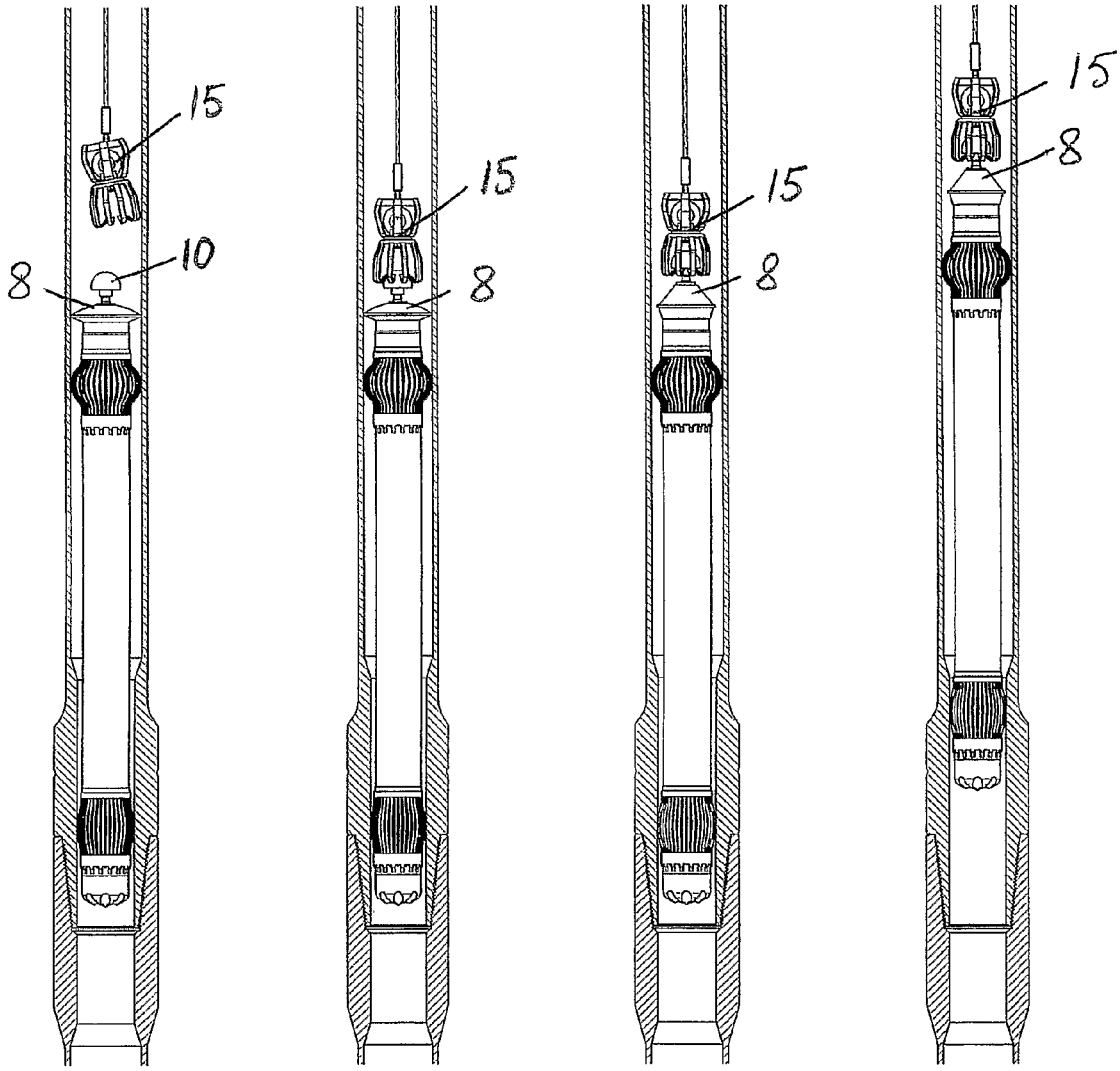

FIG. 5 is a longitudinal section of the apparatus 1 from FIG. 4 when the top end part 7 passes a connection of two drill pipes i.e., a narrowing of the drill string 11 with a reduced diameter. The wiper device 8 will then be compressed so that the edge 14 has a smaller diameter than in FIG. 4.

Since the apparatus 1 will always be on the top of the fluid surface 13, it will normally be simple to remove the apparatus 1 when pulling out the drill string 11. In general, the fluid surface 13 will be slightly above the drill floor when the tripping operation starts. The fluid surface 13 will drop as the drill string is pulled out.

Should the fluid surface be at such a low level that it is difficult for the operator to get hold of the apparatus 1, retrieval equipment 15, for example, fishing gear, can be used to retrieve the apparatus 1. This is shown in FIGS. 6*a*-6*d*.

Since during tripping it may sometimes be necessary to top up the drilling mud (when the fluid surface has dropped too much), a second embodiment of the apparatus may comprise one or more channels past or through the wiper device 8 to permit passage of drilling mud and to ensure that the apparatus floats in the fluid surface when drilling mud is added.

To facilitate the passage of drilling mud that is to be added, there is also provided another embodiment of the apparatus according to the invention. This embodiment comprises a wiper device 8' which is split into two or more wiper sections 16'. One or more wiper sections 16' are arranged so that it/they are axially offset from each other. An apparatus may comprises a wiper device 8' comprising two wiper sections 16', each wiper section 16' covering a part of a circular circumference, preferably 180° or more, and which are axially offset from each other. In an advantageous embodiment each wiper section covers about 200°.

FIG. 7 show a further example where the wiper device 8' is split into four wiper sections 16'. Two opposing wiper sections 16' are axially and radially offset from the two other wiper sections 16'. FIG. 8 shows a split view of the apparatus according to FIG. 7.

FIG. 9 is a side view of the same apparatus when it has been placed inside a drill string. FIG. 10 shows the apparatus when it is being pulled out from the drill string with a force F.

As mentioned above, one embodiment of the apparatus may comprise one or more channels past or through the wiper device 8 to permit passage of drilling mud and/or ensure that the apparatus floats in the fluid surface when drilling mud is added. FIG. 11 shows a further example of a wiper device 8 with drainage openings 17 that lead into a central bore or channel 18 axially through the device to allow drilling mud to pass downwards. At its bottom edge, the wiper device 8 may also comprise air holes or vents 19 as shown in FIG. 12.

The weight 10 may have other shapes than the ball shape shown in FIGS. 1-10. It may, for example, be made in the form of a disc-shaped weight 10 for compression of the wiper device 8, 8'. Optionally, the weight 10 may be incorporated into the upper part (i.e., the part above the edge 14) of the wiper device 8, 8' in order to cause the edge 14 to be pressed against the interior surface 12. One example of an internally arranged weight 10 is shown in FIG. 11. The weight 10 may, for example, have a recess 20 (fish neck) as shown in FIG. 11 for attaching the fishing gear for retrieval of the apparatus. The apparatus 1 may also have other types of devices for attaching fishing gear for retrieving the apparatus.

Drilling mud has varying mud weight. Consequently, a favourable embodiment of the apparatus has replaceable weights/weight elements. An example of this is shown in FIG. 11 where the weight element 21 can be unscrewed and replaced.

It is also possible to attach sensors and other measuring devices to the apparatus 1. For example, there may be attached a device or devices for measuring the internal diameter of drill pipes, the length of each individual drill pipe and/or measuring the straightness of each individual drill pipe. Other examples of additional applications are the identification of wash-out, i.e., that there is a leakage when the pressure inside the drill pipe increases. In addition, measurement of corrosion inside the drill pipe can be made when the internal diameter of the drill string changes. The centralisers 3 may also have

The invention claimed is:

1. An apparatus for cleaning drilling mud from the interior surfaces of drill pipe of a drill string during tripping, the apparatus having a mass and a volume such that it is able to float on or about surface of the drilling mud in the drill string during the tripping operation, the apparatus comprising:

a wiper device, having a bellows-shape; and a weight at or adjacent the top of the wiper device, configured by the gravitational force of the weight to compress the wiper device so that it expands towards the interior surfaces of the drill pipe to urge the wiper device against the interior surfaces of the drill pipe so that the wiper device can wipe the interior surfaces of the drill pipe.

2. An apparatus according to claim 1, wherein the apparatus comprises one or more channels past or through the wiper device which permit the passage of drilling mud.

3. An apparatus according to claim 1, wherein the wiper device comprises two or more wiper sections which are arranged axially and radially offset from each other.

4. An apparatus according to claim 1, wherein the wiper device alters shape depending on variable diameters of the drill pipe, so as to pass through the drill pipe while wiping the interior surfaces of the drill pipe.

5. An apparatus according to claim 1, wherein the apparatus further comprises one or more weight elements that can be attached and removed in order to change the mass and volume of the apparatus.

* * * * *